US009611557B2

(12) United States Patent
Carroll

(10) Patent No.: US 9,611,557 B2
(45) Date of Patent: Apr. 4, 2017

(54) SEAL ASSEMBLIES FOR CATHODE COLLECTOR BARS

(71) Applicant: Mid Mountain Materials, Inc., Mercer Island, WA (US)

(72) Inventor: Tony G. Carroll, Evansville, IN (US)

(73) Assignee: Mid Mountain Materials, Inc., Mercer Island, WA (US)

( * ) Notice: Subject to any disclaimer, the term of this patent is extended or adjusted under 35 U.S.C. 154(b) by 412 days.

(21) Appl. No.: 13/840,398

(22) Filed: Mar. 15, 2013

(65) Prior Publication Data

US 2014/0042021 A1 Feb. 13, 2014

Related U.S. Application Data

(60) Provisional application No. 61/718,097, filed on Oct. 24, 2012, provisional application No. 61/681,560, filed on Aug. 9, 2012.

(51) Int. Cl.

| | |
|---|---|
| ***C25C 7/00*** | (2006.01) |
| ***C25C 7/02*** | (2006.01) |
| ***C25C 3/08*** | (2006.01) |
| ***C25C 3/16*** | (2006.01) |

(52) U.S. Cl.

CPC ..... *C25C 3/085* (2013.01); *C25C 3/16* (2013.01)

(58) Field of Classification Search

CPC .... C25C 3/06; C25C 3/08; C25C 3/10; C25C 3/16; C25C 7/00; C25B 9/00; C25B 9/04

USPC ..... 204/279, 297.01

See application file for complete search history.

(56) References Cited

U.S. PATENT DOCUMENTS

| | | | | |
|---|---|---|---|---|
| 4,033,836 | A | 7/1977 | Holmes | |
| 4,619,750 | A | 10/1986 | Bessard | |
| 5,592,953 | A * | 1/1997 | Delao | 128/882 |
| 5,826,886 | A | 10/1998 | Hauff et al. | |
| 6,231,745 | B1 | 5/2001 | Homley | |
| 6,387,237 | B1 | 5/2002 | Homley | |
| 7,618,519 | B2 | 11/2009 | Bonnafous | |
| 7,776,190 | B2 | 8/2010 | Hiltmann | |
| 2008/0308415 | A1 | 12/2008 | Hiltmann | |
| 2010/0258434 | A1 | 10/2010 | Bayer | |

(Continued)

FOREIGN PATENT DOCUMENTS

| | | |
|---|---|---|
| FR | 2535537 A1 | 5/1984 |
| JP | 8017399 A | 1/1996 |

(Continued)

OTHER PUBLICATIONS

Translation of RU 106251 U1, cited in IDS.*

(Continued)

*Primary Examiner* — Luan Van
*Assistant Examiner* — Alexander W Keeling
(74) *Attorney, Agent, or Firm* — Christensen O'Connor Johnson; Matthew Balint; Llewellyn Lawson

(57) ABSTRACT

The cathode collector bar end portion extending through a window in a sidewall of an electrolytic cell for refining aluminum is snugly received in a central opening of a seal assembly. Such seal assembly maintains a hermetic seal preventing ingress of air through the sidewall window while permitting longitudinal (horizontal) movement of the collector bar and also movement in a vertical plane (side to side, or up and down, or diagonally) which can be caused by changing heat conditions inside the cell.

9 Claims, 7 Drawing Sheets

(56) References Cited

U.S. PATENT DOCUMENTS

2013/0299344 A1 11/2013 Carroll et al.

FOREIGN PATENT DOCUMENTS

| | | | |
|---|---|---|---|
| RU | 1 739 682 | C | 1/1995 |
| RU | 2 095 485 | C1 | 11/1997 |
| RU | 2 108 414 | C1 | 4/1998 |
| RU | 2 281 347 | A | 5/2006 |
| RU | 106251 | U1 | 7/2011 |
| SU | 865992 | A1 | 9/1981 |
| WO | WO 2012/091633 | A2 | 7/2012 |
| WO | WO 2012/091633 | A3 | 7/2012 |

OTHER PUBLICATIONS

International Search Report and Written Opinion mailed Nov. 14, 2013, issued in corresponding International Application No. PCT/US2013/032427, filed Mar. 15, 2013, 8 pages.

Eurasian Office Action mailed Jun. 24, 2016, issued in corresponding Eurasian Application No. 201492113, filed Mar. 15, 2013, 1 page.

AZO Materials, "Refractories—An Introduction to the Types of Monolithic Refractories," 2012, http://www.azom.com/article.aspx?ArticleID=1408.

International Search Report mailed Jun. 7, 2012, in corresponding International Application No. PCT/RU2011/001025, filed Dec. 26, 2011, 4 pages.

* cited by examiner

SEAL ASSEMBLIES FOR CATHODE COLLECTOR BARS

CROSS-REFERENCES TO RELATED APPLICATIONS

This application claims the benefit of U.S. Provisional Application No. 61/718,097, filed Oct. 24, 2012, and U.S. Provisional Application No. 61/681,560, filed Aug. 9, 2012, the disclosures of which are hereby expressly incorporated by reference herein.

BACKGROUND

The present invention relates to sealing the end portions of cathode collector bars used in electrolytic cells for production of aluminum. Such cells (also known as pots) typically have an outer metal shell, refractory lining/filler material defining an area for pooling of aluminum metal and electrolyte, and upper anodes exposed to the electrolyte-aluminum pool. Carbon cathode blocks are located at the bottom of the pool area below the anodes. The cathode collector bars typically are encased in the carbon cathode blocks and have opposite ends that project through holes in the shell walls for connection to external conductor buses. Representative constructions are shown in the following publications and the references cited therein:

U.S. Pat. No. 4,619,750 (Cathode Pot for an Aluminum Electrolytic Cell);

U.S. Pat. No. 6,231,745 (Cathode Collector Bar);

U.S. Pat. No. 6,387,237 (Cathode Collector Bar With Spacer for Improved Heat Balance and Method);

U.S. Patent Publication No. 2008/0308415 (Cathodes for Aluminum Electrolysis Cell With Expanded Graphite Lining);

U.S. Pat. No. 7,618,519 (Cathode Element for Use in an Electrolytic Cell Intended for Production of Aluminum);

U.S. Pat. No. 7,776,190 (Cathodes for Aluminum Electrolysis Cell With Expanded Graphite Lining);

U.S. Patent Publication No. 2010/0258434 (Composite Collector Bar).

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The present invention provides a seal assembly for a cathode collector bar where it extends through a window in a sidewall of an electrolytic cell for refining aluminum. Such seal assembly maintains a hermetic seal preventing ingress of air through the sidewall window while permitting longitudinal (horizontal) movement of the collector bar and also movement in a vertical plane (side to side, or up and down, or diagonally) which can be caused by changing heat conditions inside the cell. In one embodiment, the seal assembly includes a seal member that slides between frame sheets secured around the window. In another embodiment the seal assembly includes a tapered boot having one end joined to a base member or sheet secured to the cell sidewall and a remote end forming a central opening to receive the bar, with a mechanical tightening member to adjust the fit of the boot on the bar.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
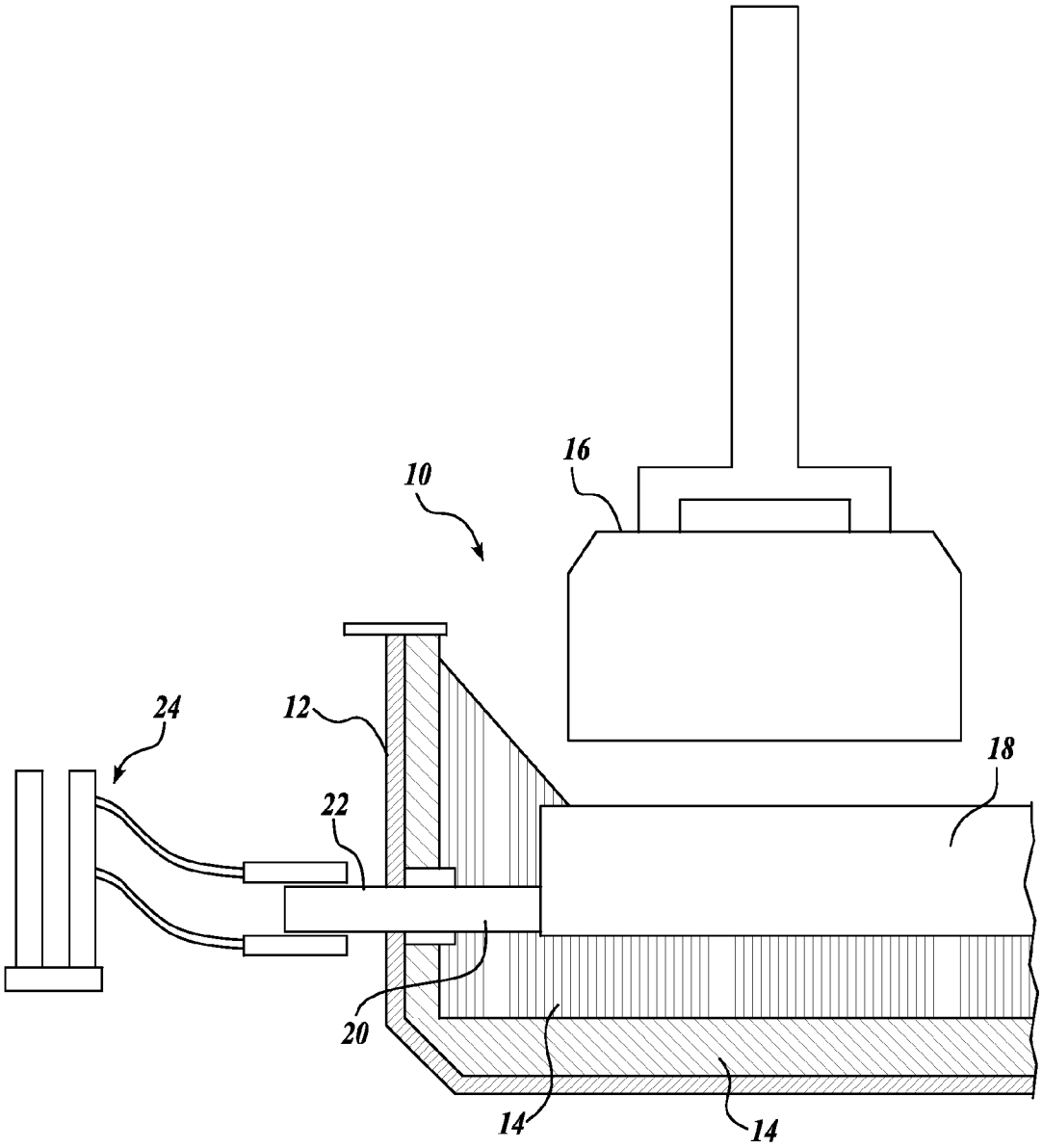
Fig. 1. (PRIOR ART)
FIG. 1 (prior art) is a very diagrammatic, fragmentary end elevation of a generic electrolytic cell for aluminum production, with parts broken away.

With reference to FIG. 1, a known electrolytic cell 10 for production of aluminum, of the general type with which the present invention is concerned, has an outer shell 12 and inner layers of refractory lining/filler materials 14. An upper anode 16 extends below the top of the shell into a "pool" area which, during operation, contains molten electrolyte and liquid aluminum metal. Electrical current passes from the anode, through the pool, to a carbon cathode structure 18. Such current is conveyed from the cell by metal cathode collector bars 20. Bars 20 have end portions 22 that project through openings in the sidewalls of the shell 12. At the exterior of the shell, the collector bars connect to a bus conductor assembly 24.

Commercial electrolysis cells are designed for continuous service for at least several years at high operating temperatures (such as 940° C.). Intermittent operation typically is not practical because of serious stresses caused during startup due to different temperature characteristics of the materials used. In addition, no matter how careful the design and care taken at startup, some structural damage may occur which is not immediately detected or preventable, resulting in premature pot failure. For example, operating conditions are not static because the exact composition of the electrolyte-aluminum pool changes as more electrolyte is added and aluminum metal is tapped off. Temperature gradients can develop in unpredictable manners. Corrosive compositions may percolate through some of the pot components and/or penetrate through small cracks or gaps that are undetected. Another factor is believed to be leakage of air through the sidewall openings for the cathode collector bars which can cause oxidation of the collector bar and cathode materials. Sometimes an attempt is made to lessen the likelihood of the ingress of air by a rigid connection of the collector bar to the shell wall. In other designs, a "seal" is formed by use of a high temperature mastic or "moldable" composition. Such compositions typically are rigid when set, but may allow longitudinal sliding movement of the cathode collector bar, which can be important. Unyielding connections of the cathode collector bar ends to the shell wall can induce tensile stresses in the carbon cathode blocks, such as if the collector bars flex, warp, or creep due to heat expansion and contraction.

The present invention provides a seal assembly for the area where a collector bar end portion extends through an electrolytic cell sidewall. Such assembly maintains a hermetic seal preventing ingress of air through the sidewall opening while permitting longitudinal (horizontal) movement of the collector bar and also movement in a vertical plane (side to side, or up and down, or diagonally) which can be caused by changing heat conditions inside the cell. In the embodiment shown in FIGS. 2 and 3, the seal assembly 30 in accordance with the present invention is secured to the exterior of a cell sidewall 12, covering the hole or window through which the collector bar end portion 22 extends. With reference to FIG. 3, the seal assembly includes an inner frame piece or sheet base member 32 with a central opening 34 of a size and shape approximately the same as the sidewall window through which the collector bar end portion extends. An outer frame or sheet 36 is shaped identically to the inner sheet. A narrow spacer 38 is interposed between the inner and outer sheets 32 and 36, as is the sealing piece or sheet 40 which has an opening 42, preferably die cut, that substantially identically matches the cross-sectional exterior profile of the collector bar end portion. When the sheets 32 and 36 are secured together with the spacer 38 between them, the sealing sheet 40 fits in the larger opening 44 of the spacer 38, sandwiched between the frame pieces 32 and 36 but not connected to them. The parts are sized and proportioned such that the sealing sheet 40 is slidable within the spacer opening 44, up and down, side to side, and diagonally from a centered position, but always with a continuous marginal portion or lip of the sealing sheet interposed between the outer surface of sheet 32 and the inner surface of sheet 36.

Figure 2:
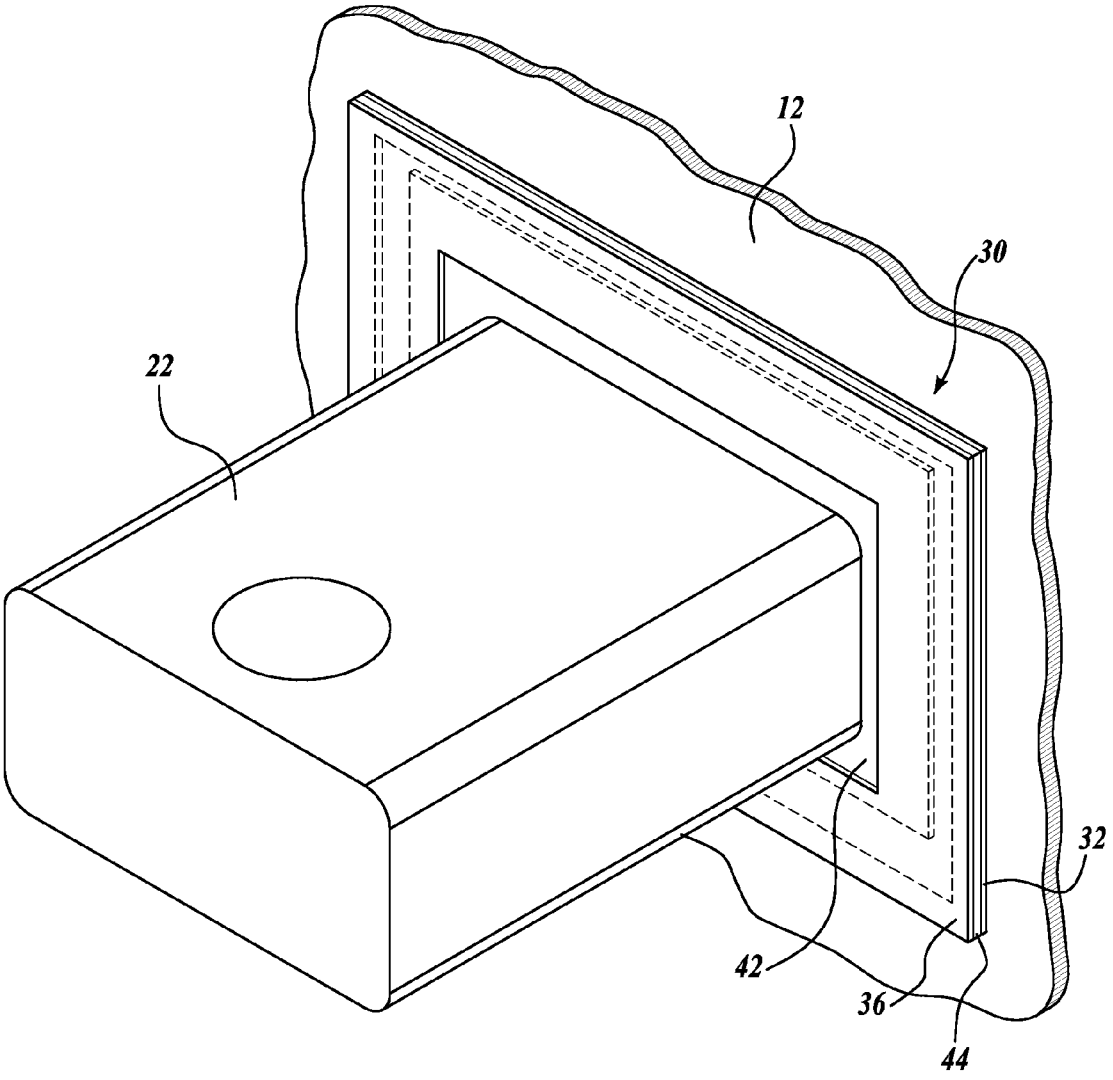
FIG. 2 is a fragmentary top perspective of a seal assembly for cathode collector bars as applied to a sidewall of an electrolytic cell in the area of the opening for a projecting end portion of a cathode collector bar.
Figure 3:
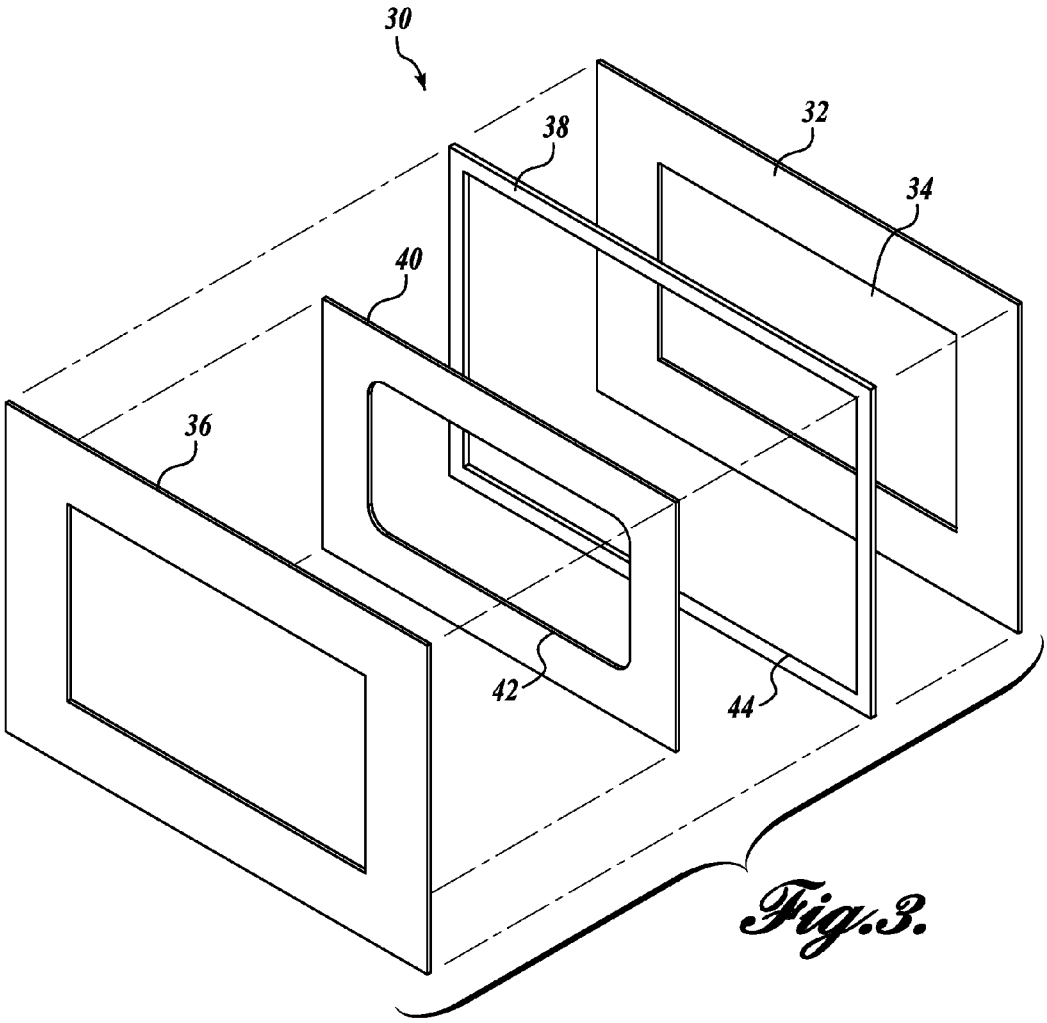
FIG. 3 is a top perspective showing component parts of the seal assembly of FIG. 2 in exploded relationship.

With reference to FIG. 2, the seal assembly 30 can be installed from the exterior of the cell, first by fitting the collector bar end portion 22 through the opening 42 of the sealing sheet 40 and then by securing the back side of the inner sheet 32 to the marginal portion surrounding the window in the cell sidewall 12. The fit of the sealing sheet 42 on the bar 22 is sufficiently snug to achieve the desired hermetic seal but not so tight as to prevent longitudinal sliding movement of the bar relative to the sealing sheet 42 due to heat expansion and contraction. Forces tending to move the bar laterally, diagonally, or up and down, result in the sealing sheet 40 sliding in the channel formed between the inner and outer sheets 32, 36, i.e., the space between such sheets to the inside of the spacer 44. This construction allows universal movement of the cathode bar as may be induced during start up and during operation of the electrolytic cell, and lessens the stresses that may otherwise be applied to interior components of the cells such as the carbon cathode blocks.

Materials for the components of the seal assembly 30 must be chosen carefully due to the extreme operating conditions to which they are exposed. Such materials necessarily are noncombustible, high temperature resistant, and refractory both in the sense of having little or no tendency to expand or contract at the high temperature operating conditions and in the sense of being resistant to chemicals of the type commonly encountered in use such as hydrofluoric gas. The sealing sheet 42 must be capable of being cut, preferably die cut, to the exact shape of the outer periphery of the cathode collector bar, but also have some degree of flexibility along its inner margin to accommodate for transverse heat expansion and contraction of the bar, while still allowing sliding movement of the bar through the opening of the sheet and maintaining the hermetic seal. In a representative embodiment, appropriate materials include materials available from Mid-Mountain Materials, Inc., of Mercer Island, Washington, as follows:

for the frame sheets 32 and 36: ARMATEX® QF40 (a refractory cloth comprised of a fiberglass fabric coated with high temperature resistant refractory compound);

for the spacer 38 and the sliding seal sheet 40: ARMATEX® SBQF100 (a refractory cloth of heavyweight fiberglass fabric coated with high temperature resistant refractory compound on one side and silicone rubber on the other side).

The edge portions of the sheets 32 and 36 and spacer 38 can be secured together by sewing using a high temperature thread (such as a thread formed from Mid-Mountain ARMATEX® SGT18 which is composed of twisted and plied together fiberglass fibers).

Securing of the back of the base sheet 32 to the outside of the cell sidewall 12 around the window through which the collector bar extends can be by a high temperature adhesive or cement compatible with the frame and cell wall materials. Mid-Mountain THERMOSEAL® 1000SF cement works well for securing the QF40 fabric to steel and meets the high temperature requirements while withstanding thermal expansion and contraction under potentially fluctuating heat conditions.

Other materials with similar properties could be used.

Figure 4:
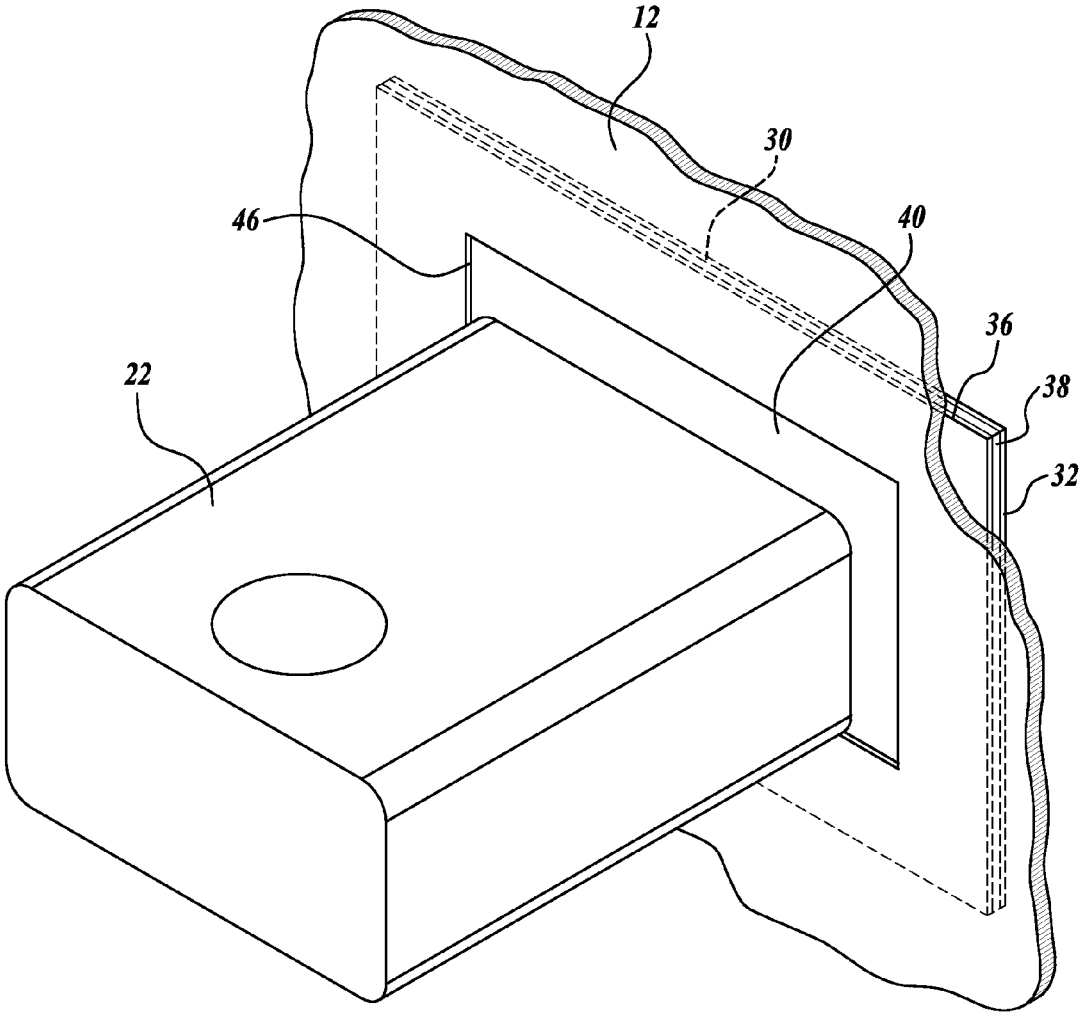
FIG. 4 is a top perspective of the seal assembly of FIGS. 2 and 3 in an alternative installation on an electrolytic cell.

In the case of new cell construction or refurbishing of an existing cell, the assembly 30 can be installed from the inside, as represented in FIG. 4. Seal assembly 30, most of which is shown in broken lines in FIG. 4, is secured on the inside surface of sidewall 12 around the sidewall window opening 46. The seal sheet 40 having the opening precisely and snugly receiving the collector bar end portion 22 is slidable in the space between the frame sheet or base member 36 and sheet 32 offset slightly away therefrom by the spacer material 38. The same materials and high temperature adhesive or cement can be used in this application as was described with reference to the installation represented in FIG. 2.

Relative dimensioning of the parts is important to assure that the cathode collector bar is movable to the maximum degree permitted by the cell window without the edge of the sealing sheet 40 being exposed. Similarly, the channel between the frame sheets 32 and 36 must be of sufficient depth to allow such maximum movement without an outer edge of the sealing sheet coming into contact with the spacer. This can be illustrated with actual dimensions for a representative embodiment in which the cathode collector bar is of rectangular cross section (ignoring rounded corners) 230 mm by 115 mm. The cell window can be rectangular with length and width dimensions of 262 mm by 150 mm. Thus, from a centered position, the maximum "sideways" movement of the bar in the cell window is 16 mm in each direction, and the maximum up and down movement of the collector bar in the cell window is 17.5 mm from the centered position. For these dimensions, the outer dimensions of the sealing sheet 40 can be 310 mm by 190 mm, so if the sheet shifts the maximum amount permitted by the fit of the collector bar in the cell window, there still is a substantial lip or marginal portion of the sealing sheet covering the cell window, fitted in the channel of the seal assembly, and not engaged against the filler piece which can have a central opening of about 345 mm by 225 mm and a width along each side of 12.5 mm.

Figure 5:
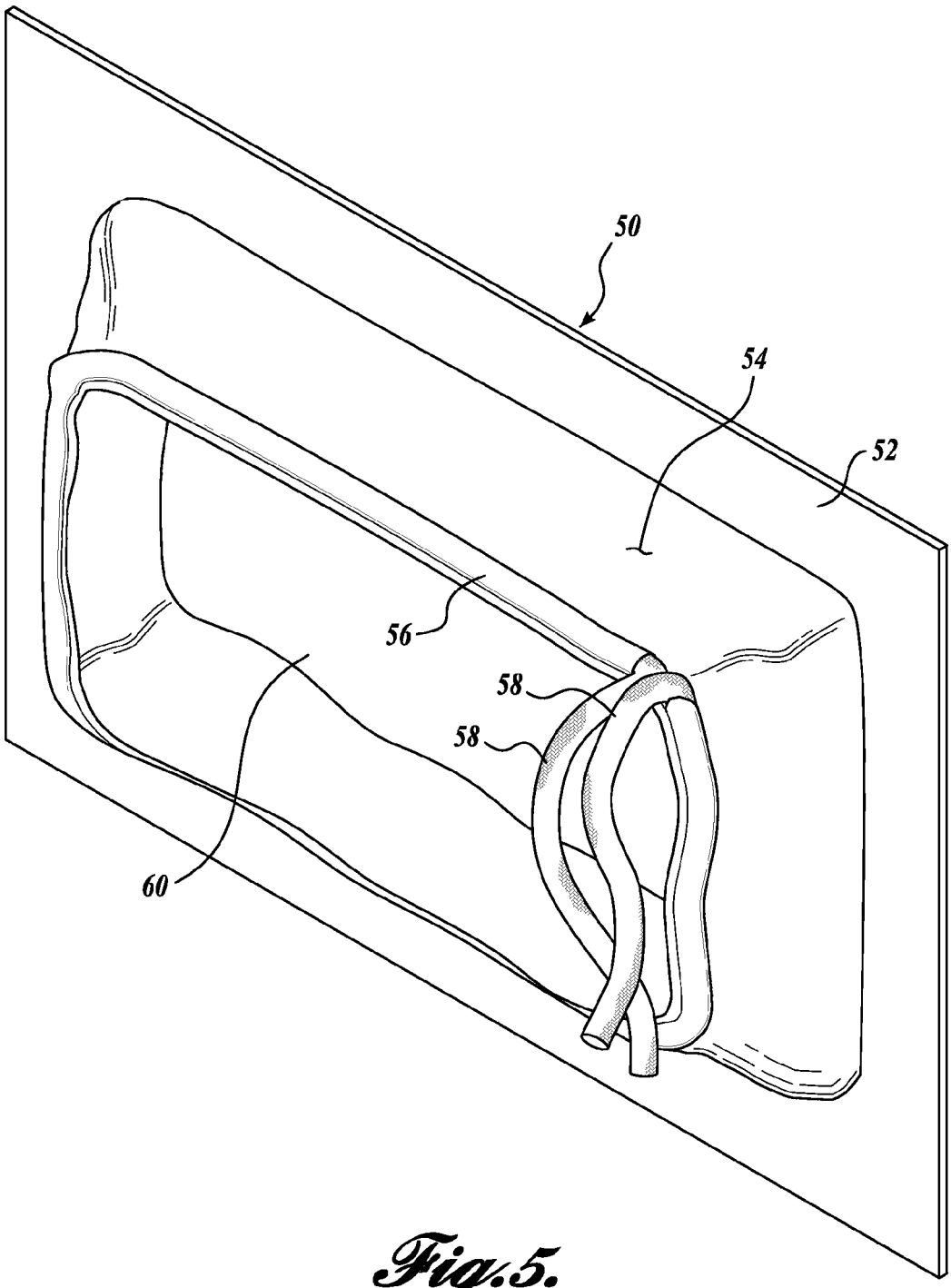
FIG. 5 is a top perspective of a second embodiment of a seal assembly for cathode collector bars in accordance with the present invention.
Figure 6:
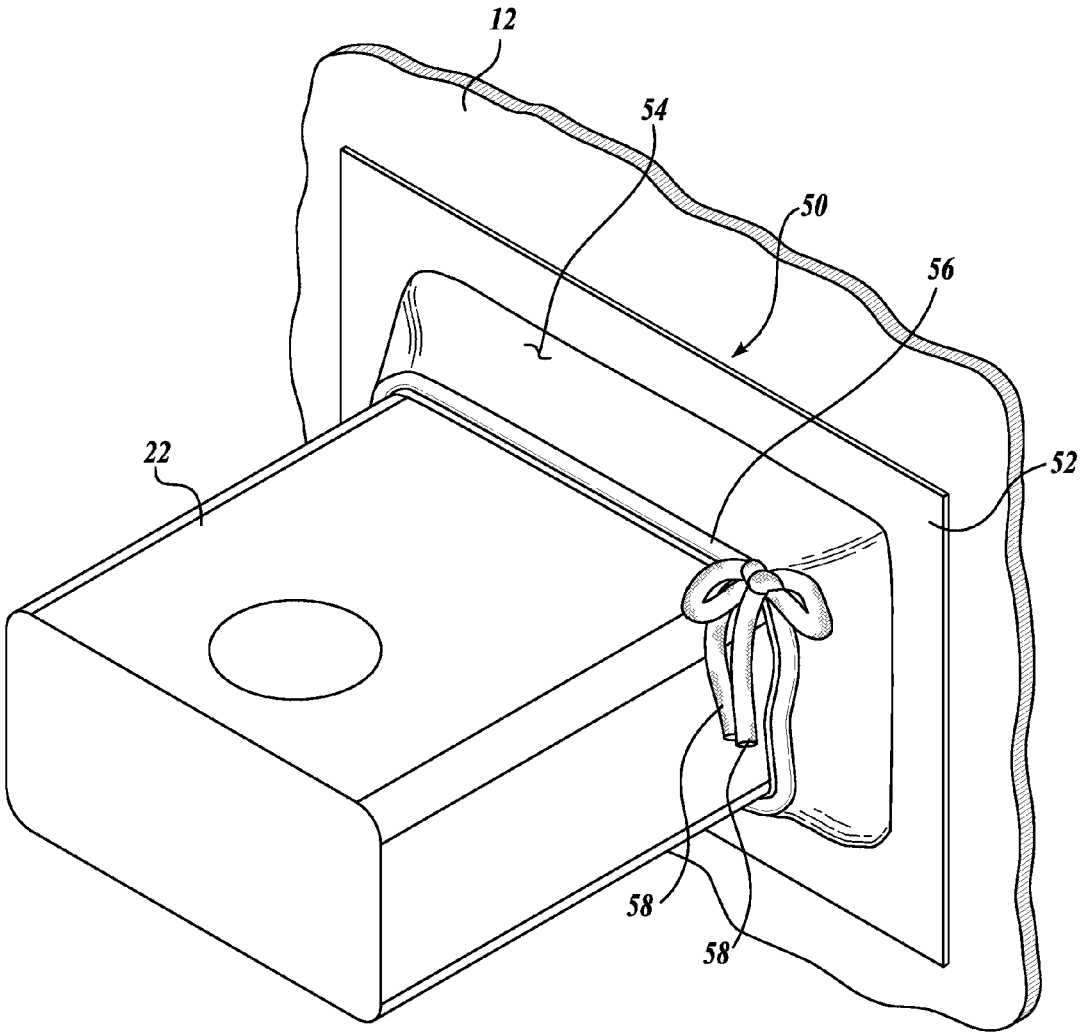
FIG. 6 is a top perspective of the second embodiment of a seal assembly as installed on a sidewall of an electrolytic cell.
Figure 7:
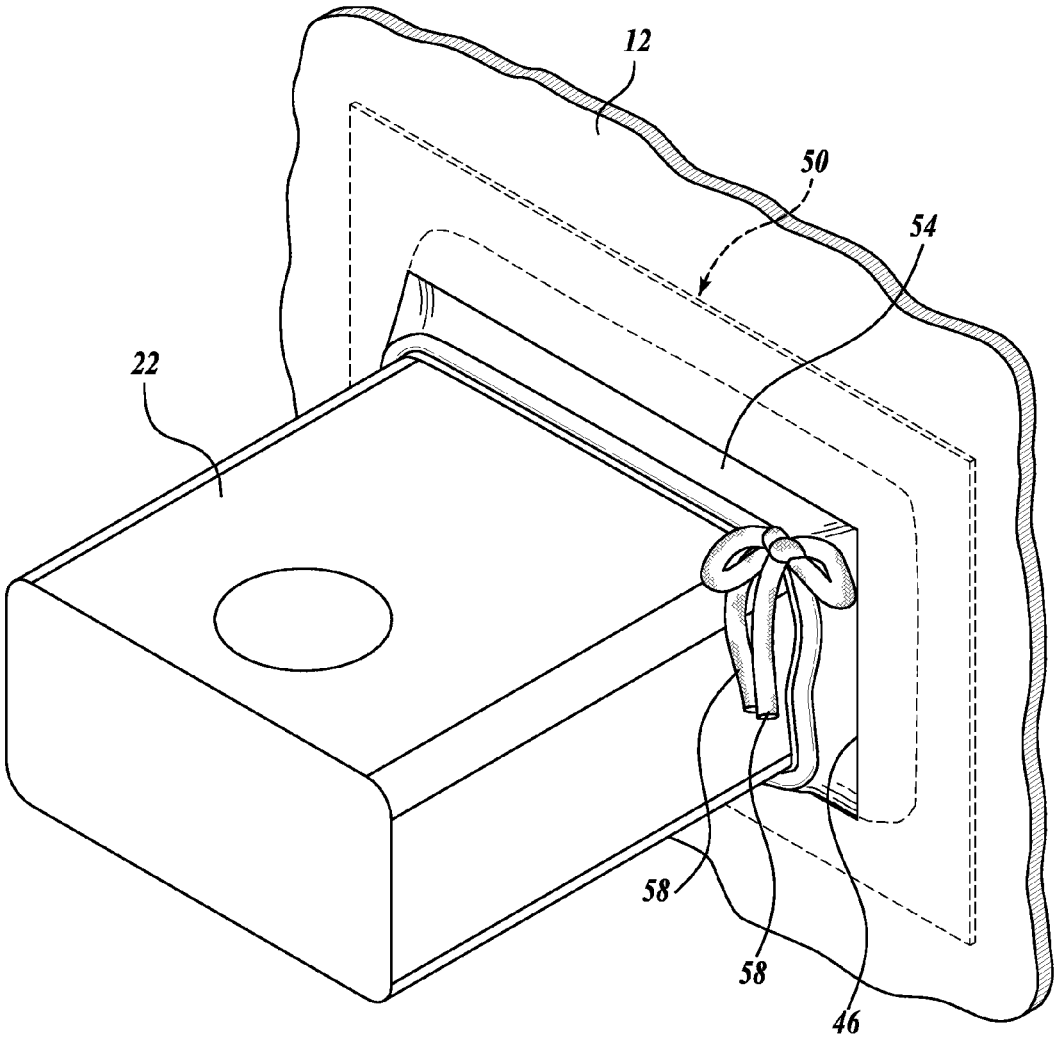
FIG. 7 is a top perspective corresponding to FIG. 6 but showing an alternative installation on an electrolytic cell.

With reference to FIGS. 5, 6, and 7, an alternative sealing assembly 50 in accordance with the present invention has a base sheet 52 for securing of the assembly around a cell window. High temperature resistant refractory cloth or fabric of the type described above can be used. Secured to the base sheet is a short, tapered section or boot 54 of a more flexible high temperature resistant refractory material which terminates in a hemmed portion 56 (or closely spaced loops) for a mechanical tightening member in the form of a drawstring 58 (such as a high temperature resistant refractory cord). The base sheet 52 can be secured to the cell wall 12, such as by a suitable high temperature refractory adhesive or cement. A hermetic seal with the collector bar end portion 22 is enhanced by tightening the drawstring 58 and knotting it or otherwise securing it in a taut condition. Preferably, the opening 60 (FIG. 5) of the tapered portion 54 is sized for snugly receiving the bar, and the seal is enhanced by the tightened drawstring. The cord material can be selected to have a slight degree of resilience so as to adjust the fit of the seal assembly 50 on the bar as the bar increases or decreases in cross-sectional area due to heat expansion or contraction.

As seen in FIG. 7, similar to the previously described embodiment, the sealing assembly 50 can be applied with its base 52 at either the interior or exterior of the cell wall 12.

Regardless of the form of the invention used, a reliable hermetic seal can be achieved without injecting mastic or moldable material.

While illustrative embodiments have been illustrated and described, it will be appreciated that various changes can be made therein without departing from the spirit and scope of the invention.

The embodiments of the invention in which an exclusive property or privilege is claimed are defined as follows:

1. A seal assembly for an end portion of a horizontally extending cathode collector bar passing through a window in a sidewall of an electrolytic cell, which bar as a cross section of a size smaller than the cell window for permitting movement of the bar in a vertical plane in the window, said seal assembly comprising a seal member having a central opening snugly receiving the collector bar end portion in a hermetic sealing condition but permitting lengthwise movement of the bar end portion through the central opening, the sealing assembly further including a base member adapted to be secured to the cell sidewall around the window in a hermetic sealing condition, the seal assembly being constructed and arranged to permit movement of the bar end portion in the vertical plane to the full extent permitted by the fit of the bar end portion in the window without affecting the hermetic sealing condition of the bar end portion in the central opening or the hermetic sealing condition of the base member around the window, wherein the base member and the seal member are secured together, the seal member comprising flexible material having the central opening, and a mechanical tightening member configured to enable manual tightening and loosening of the fit of the central opening around the bar end portion.

2. The seal assembly defined in claim 1, in which the seal member and the base member are noncombustible, high temperature resistant, refractory material.

3. The seal assembly defined in claim 2, in which the seal member and base member comprise fiberglass fabric coated with high temperature resistant refractory compound.

4. The seal assembly defined in claim 1, in which the base sheet is secured to the cell sidewall by adhesive or cement.

5. The seal assembly defined in claim 1, in which the base member is secured to the exterior surface of the cell sidewall around the window.

6. The seal assembly defined in claim 1, in which the base member is secured to the interior surface of the cell sidewall remote from the adjacent end of the bar end portion.

7. The seal assembly defined in claim 1, in which the mechanical tightening member is a drawstring.

8. The seal assembly defined in claim 1, in which the seal member is a tapered boot of flexible high temperature resistant refractory material having a first end joined to the base sheet and a second end remote from the base sheet and forming the central opening.

9. The seal assembly defined in claim 8, in which the second end of the seal member is hemmed, and including a drawstring fitted in the hemmed portion of the seal member.

* * * * *